US005720481A

United States Patent [19]

Graham

[11] Patent Number: 5,720,481

[45] Date of Patent: Feb. 24, 1998

[54] EDUCATIONAL PUZZLE TOY SET

[76] Inventor: Stanford A. Graham, 2120 N. Valley View Dr., Layton, Utah 84040

[21] Appl. No.: 640,573

[22] Filed: May 1, 1996

Related U.S. Application Data

[63] Continuation-in-part of Ser. No. 451,481, May 26, 1995, abandoned.

[51] Int. Cl.[6] ..... A63F 9/10

[52] U.S. Cl. ..... 273/157 R; 434/406

[58] Field of Search ..... 273/153 R, 156, 273/157 R, 157 A; 434/96, 269, 272, 406

[56] References Cited

U.S. PATENT DOCUMENTS 175,519 3/1876 Steiger ..... 273/157 R

FOREIGN PATENT DOCUMENTS 1173869 9/1984 Canada ..... 273/157 R 2442960 3/1976 Germany ..... 273/157 R 3400353 7/1985 Germany ..... 273/157 R 2157962 11/1985 United Kingdom ..... 273/157 R 2252255 8/1992 United Kingdom ..... 273/157 R

OTHER PUBLICATIONS

Business Week, "Puzzles Go Full Circle", Jul. 10, 1965, p. 68, 273/157 r.

*Primary Examiner*—William M. Pierce

*Attorney, Agent, or Firm*—Marcus G. Theodore

[57] ABSTRACT

An educational toy puzzle set having separate interconnecting puzzle pieces each shaped as the silhouette or outline of an animal, plant, or toy with one side including a word description or name of the animal or plant, which can be used as a play item independent of puzzle usage, and an interlocking puzzle border comprised of border pieces, which when assembled, secure and hold together the assembled puzzle pieces; said puzzle border colored and patterned proximate each puzzle piece with a pictorial setting of the eco-system or environment where an adjacent animal or plant puzzle piece is found.

18 Claims, 4 Drawing Sheets

EDUCATIONAL PUZZLE TOY SET

RELATED APPLICATIONS

This application is a continuation-in-part application of the originally filed application entitled Puzzle Toy Set, Ser. No. 451,481, filed May 26, 1995, now abandoned.

BACKGROUND OF THE INVENTION

1. Field

This invention pertains to puzzles. More particularly it provides a puzzle of separate interconnecting pieces each shaped as a toy which can be used as a play item independent of puzzle usage, and as an illustrated flash card teaching aid.

2. State of the Art

Numerous puzzles are known. Schoonderbeek, FR 922,298 illustrates interconnecting puzzle pieces fitting within a template board shaped as animals, humans, etc. which can be disassembled to form individual play items. Tranter, AUS 232,679 illustrates a puzzle assemblage of reversible two faced puzzle pieces. Bollman, et al., DT 2442960A1 discloses a jigsaw puzzle consisting of a multiple picture on which at least two partially different pictures can be viewed from different directions, preferably in stereo. Ozrovitz, U.S. Pat. No. 5,213,507 discloses an instructional child's story and picture book including a front cover, a back cover and a plurality of pages, with at least one page including text, and the opposite page including a puzzle with interlocking puzzle pieces. Barry, U.S. Pat. No. 4,365,809 discloses a three figure dissection puzzle of nine basic geometric pieces, alternatively assemblable into a rectangle, square or five-pointed star, the nine pieces being subdividable and in their largest form being three right triangles, four isosceles triangles, and two quadrilaterals. Young, U.S. Pat. No. 3,721,446 discloses an interlocking puzzle formed of a plurality of interfitting pieces which are interlocked with pins to form an animal, when assembled. Kodaka, U.S. Pat. No. Des. 257,370 discloses an ornamental design for a dinosaur figure assembled from interconnecting skeletal pieces. Kodaka, U.S. Pat. No. Des. 257,371 discloses another ornamental design for a dinosaur figure assembled from interconnecting skeletal pieces. Kodaka, U.S. Pat. No. Des. 257,372 discloses still another ornamental design for a dinosaur figure assembled from interconnecting skeletal pieces. Kodaka, U.S. Pat. No. Des. 257,373 discloses still another ornamental design for a dinosaur figure assembled from interconnecting skeletal pieces. Kodaka, U.S. Pat. No. Des. 257,369 discloses another ornamental design for a mastodon figure assembled from interconnecting skeletal pieces.

Cited for general interest is Ach, U.S. Pat. No. 3,477,167 which discloses figure shaped building blocks with integral connectors, each shaped like an animal with arms, legs, a body and a head, the proportions and shape of the block being such that the arms and the legs of a first block will embrace and fit the head and body of a second block of similar construction. The animal may be a human figure, or may be a domestic, farm or wild animal in which case the animal block instead of having 2 arms and 2 legs will have 4 legs or the animal may be a bird in which case it will have 2 legs and 2 wings. Rasberry, U.S. Pat. No. 5,067,714 discloses a jigsaw puzzle having a plurality of differently shaped and sized inner and outer pieces which can be assembled into a plurality of arrangements. Murphy, U.S. Pat. No. 4,471,960 discloses a puzzle with multi-faced pieces capable of presenting a number of different scenes. It is comprised of a plurality of elongated pieces, each piece having a plurality of sides presenting a portion of a scene on each side. The puzzle includes a knockdown stand adapted to hold said pieces in a contiguous relationship with selective sides of said pieces in a face up relationship so that when all of the sides are aligned on the stand, all of the portions of the same scene face upwardly and are in proper contiguous relationship to present a scene. Differing sides of the pieces may then be aligned contiguously and faced upwardly so that a different scene is presented. Van Niekerk, U.S. Pat. No. 4,961,708 discloses an educational puzzle with a base panel with sequential markings having a number of holes through it into which puzzle pieces having mating pegs extending through them may be arranged on the base panel front faces in a sequence to teach differently related concepts such as number sequencing or number counting; alphabetical sequencing or work recognition; and other skills. Goldstraw et al, GB 2252255A discloses a jigsaw puzzle which can be assembled to show a scene and an aid to the assembly of the puzzle from a different angle or alteration of certain features. Godinet, U.S. Pat. No. 4,719,656 is a bad with a mattress formed of a multiplicity of individually removable juxtaposed pillows shaped in the form of an animal. Ashemimry, U.S. Pat. No. 5,362,054 is a multi-layered educational and entertaining puzzle wherein each puzzle layer independently educates and entertains. Jones, U.S. Pat. No. Des. 228,359 discloses an animal jigsaw puzzle design. Stief, G 81 26 846.7 discloses jigsaw puzzle mats of non-crumbling foam material that can be assembled from individual interlockable puzzle pieces. Wadd, CA 1173-869A provides a laminated piece jigsaw puzzle with a soft layer on which a picture is printed and attached to hard structural material. Samuals, WO 81/02843 is a multi-layered puzzle toy wherein each layer has different facial elements which can be interchanged to provide different facial expressions.

None of the foregoing provides a puzzle with interconnecting pieces, the shapes of which depict anatomically accurate animals or realistically depicted related items. These puzzle pieces have one side illustrated with a picture of the animal or item, and also include scientifically accurate information on the side opposite the illustration. Said pieces can be disassembled to form individual play items, or assembled and used as an educational instructional aid. The invention described below provides such an invention.

SUMMARY OF THE INVENTION

The invention comprises an educational puzzle toy set comprising a plurality of interlocking puzzle pieces each shaped as the silhouette or outline of an animal, plant, or toy with interconnecting arms, legs, appendages, and body parts, which when assembled form a patterned assemblage. These educational toy puzzle pieces, when disassembled, are designed for separate play. Preferably, the puzzle pieces have a common theme, such as an animal, plant, barnyard, or zoo theme, wherein each piece represents a member of a family of animals, plants or toys. These plants and animal themes may be expanded and varied to include tools, and other objects commonly found in real life in association with the animals and plants shown on the puzzle pieces.

Generally, the puzzle pieces have opposite flat front and back, or top and bottom, planer surfaces with interconnecting arms, legs, appendages, and body parts which, when interconnected, form a flat patterned assemblage structured to fit within a template. A puzzle border comprised of interlocking border pieces, which when assembled, defines a template of a corresponding shape to the patterned assemblage to secure and hold together the assembled puzzle pieces. This puzzle border is colored and patterned proximate each puzzle piece with a pictorial setting of the eco-system or environment where the animal or plant puzzle piece is found.

At least one side of the puzzle piece is colored and patterned as an animal, plant, or toy. The other side of the puzzle piece contains the name of the animal or plant, its place of origin, its size, and other informative descriptions. These named and labeled puzzle pieces may then be used by a teacher as flash cards or as an aid in teaching reading. For example, a teacher may first have a student identify the animal by reading the name on the back. Then the student may be asked to position the identified puzzle piece at its ecological position along the assembled border of the puzzle. Alternatively, a student alone could use the pieces by selecting a puzzle piece, guessing the information about the name of and information about the animal or plant, and flip over the pieces to check if the guesses were correct.

In another preferred embodiment, both sides of the puzzle pieces are colored and patterned to resemble both sides of, or the top and bottom of, an animal, plant, or toy. These puzzle pieces are generally made of sheets of wood, plastic, cardboard, or other stiff materials, forming a rigid assemblage when the puzzle pieces are put together. In one preferred embodiment, flat sheets are covered with the patterned interconnected animals, toy, or plants, and then die cut to separate them for individual play when disassembled. This type of construction not only utilizes the entire sheet to prevent manufacturing waste, it makes assembly more challenging as the colors and patterns of the pieces are separate and do not overlap to give clues as to how the parts are positioned.

Alternatively, they may be made from a soft pliable material such as rubber or sponge foam and shaped as flat or three dimensional animals, plants, or toys. For use with infants or small children, these are each sized large enough to prevent swallowing.

In one preferred embodiment, the puzzle pieces are shaped as dinosaurs with one side of the puzzle pieces are colored and patterned to show the exterior of the dinosaur, and the other side of the puzzle pieces is colored and patterned to show the skeletal bone structure of the animal. To fit within irregular spaces between the interfitting appendages of the dinosaurs when the puzzle pieces are assembled, some of the puzzle pieces may be shaped as paleontologists searching for dinosaurs, teeth, claws, or other items that may be found at a dig site.

In another preferred embodiment, the upper exposed sides of the puzzle pieces are colored and patterned with a cover sheet laminated to a rigid support sheet containing a multiple image of an animal, dinosaur, or toy. This exposed side of each puzzle piece is then covered with a Lover sheet constructed from multiple image or holographic materials. For example, to produce multiple image cover sheets, multiple images are superimposed upon one another in a grid pattern. The resulting multiple superimposed image is then laminated to a corresponding plastic grid overlay which selectively reflects different images when the piece is tilted at different angles. This multiple image construction is used to give a piece the illusion of movement during play, or to show both sides or different views of an animal or toy by moving the angle at which the puzzle piece is observed.

In one preferred embodiment, the multiple imaged puzzle piece shows the exterior of the animal, plant, dinosaur or toy when viewed at one angle, and the interior or skeletal bone structure of the animal, plant, dinosaur or toy when viewed at another angle. In another preferred embodiment, tilting the multiple imaged puzzle piece shows the legs or parts of the animal, plant, dinosaur or toy in a first position when viewed at one angle, and in a second position when viewed at another angle so that when when the piece is rapidly tilted the legs or parts of the animal, plant, dinosaur or toy appear to be moving.

Holographic image cover sheets may also be employed to provide three dimensional depth imagery to the flat puzzle pieces. These may be singular or multiple superimposed images constructed and activated in a similar manner described above.

To use the puzzle toy set as an aid in teaching, the puzzle pieces may be all designed to be from a common scientific, historical, technological, biological, etc. age, family, theme or grouping. For example, when teaching about dinosaurs, the dinosaur puzzle pieces may be selected from the same geological period. The puzzle boarder surrounding the assembled animal and plant pieces acts as a pictorial or eco-system setting with plants from the same geological period as the dinosaurs incorporated to provide an authentic geological flora and fauna setting to teach about plants and animals in existence during the same geological period.

Other puzzle themes for the puzzle pieces contemplated are amphibians, sea life, knights and castles, historical themes, evolution of cities, antique cars and planes, cowboys and Indians, movie themes, cartoon characters, fish and divers, endangered species, etc.

The puzzle toy set thus constructed provides an interesting teaching aid, which can be used to deliver an organized lecture to a group, or can be used independently by a child to learn interrelationships and themes by organizing the puzzle pieces through individual play and assembly.

DESCRIPTION OF THE ILLUSTRATED EMBODIMENTS

Figure 1:
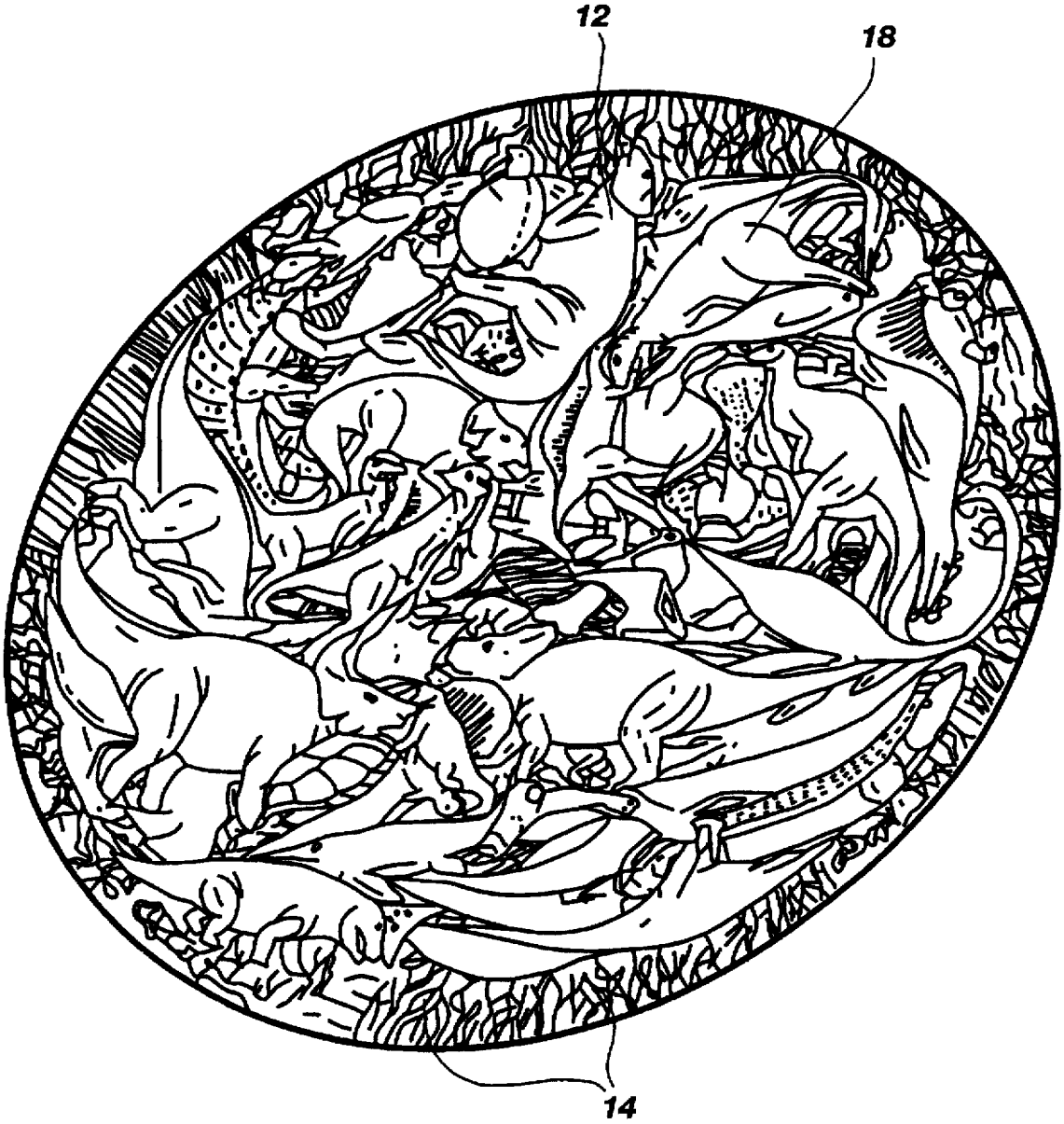
FIG. 1 illustrates a preferred embodiment of the assembled puzzle toy set.

FIG. 1 illustrates a preferred embodiment of the assembled puzzle toy set 10. It comprises a plurality of interconnected puzzle toy pieces 12 with interconnecting appendages, and body parts made of thick cardboard or compressible foam materials. Each puzzle toy piece 12 is shaped as the silhouette or outline of a dinosaur, which, when assembled forms a circular template. The individual puzzle toy pieces 12 are shaped as different dinosaurs from various periods and epoches. A puzzle boarder 14 made of interconnecting border pieces defines a corresponding center recessed circular template which holds and secures the assembled puzzle toy pieces 12 together. The border 14 contains a contemporary faunal region containing typical flora from various periods and epoches.

Figure 2:
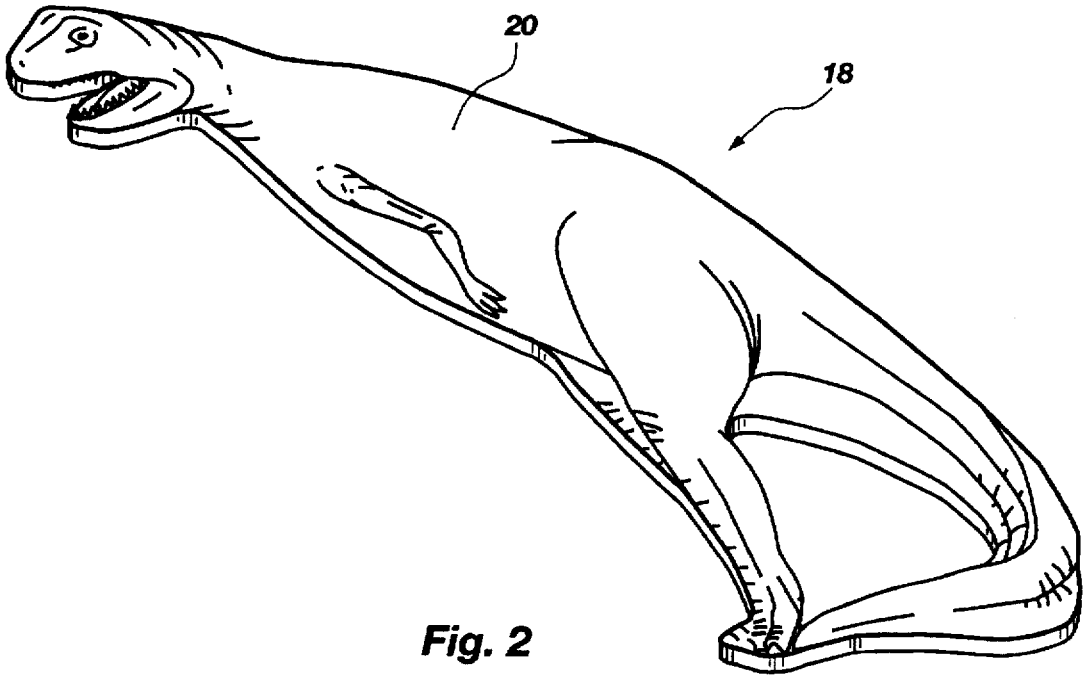
FIG. 2 is a perspective view of one of the puzzle pieces shown in FIG. 1.
Figure 3:
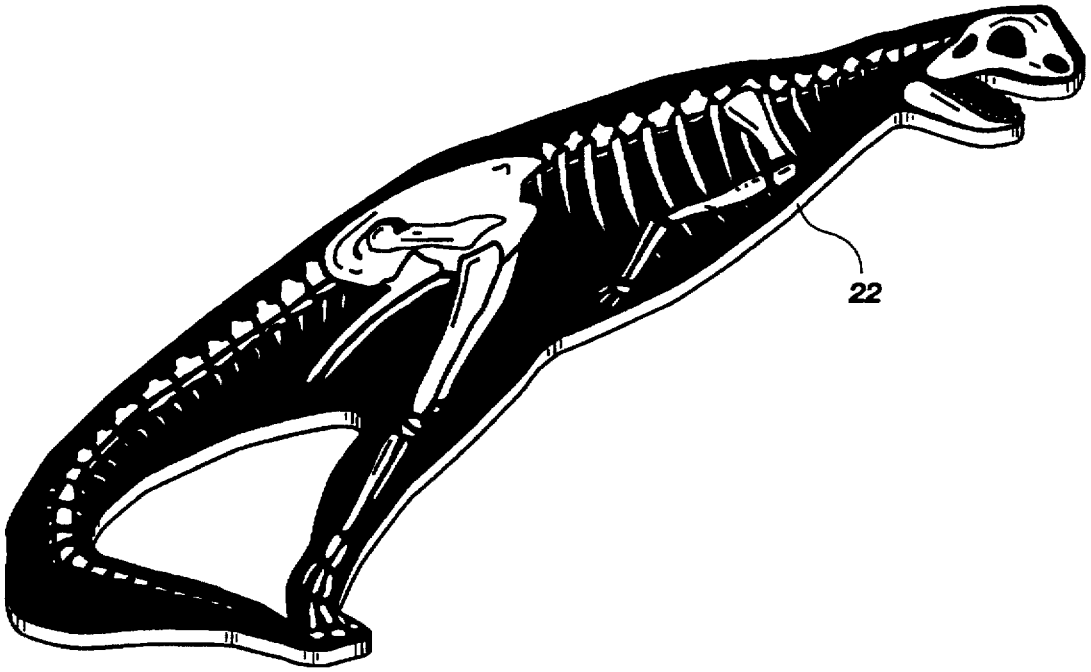
FIG. 3 is a perspective view of the other side of the puzzle piece shown in FIG. 2.

FIG. 2 is a perspective view of one side of the puzzle piece 18 shown in FIG. 1 configured as a Megalosaurus dinosaur. This puzzle piece 18 has flat opposing planer sides, with one side 20 shown in FIG. 2 colored and patterned to show the external features of the Megalosaurus. The other side 22 shown in FIG. 3 is colored and patterned to show the skeletal features of the Megalosaurus.

Figure 4:
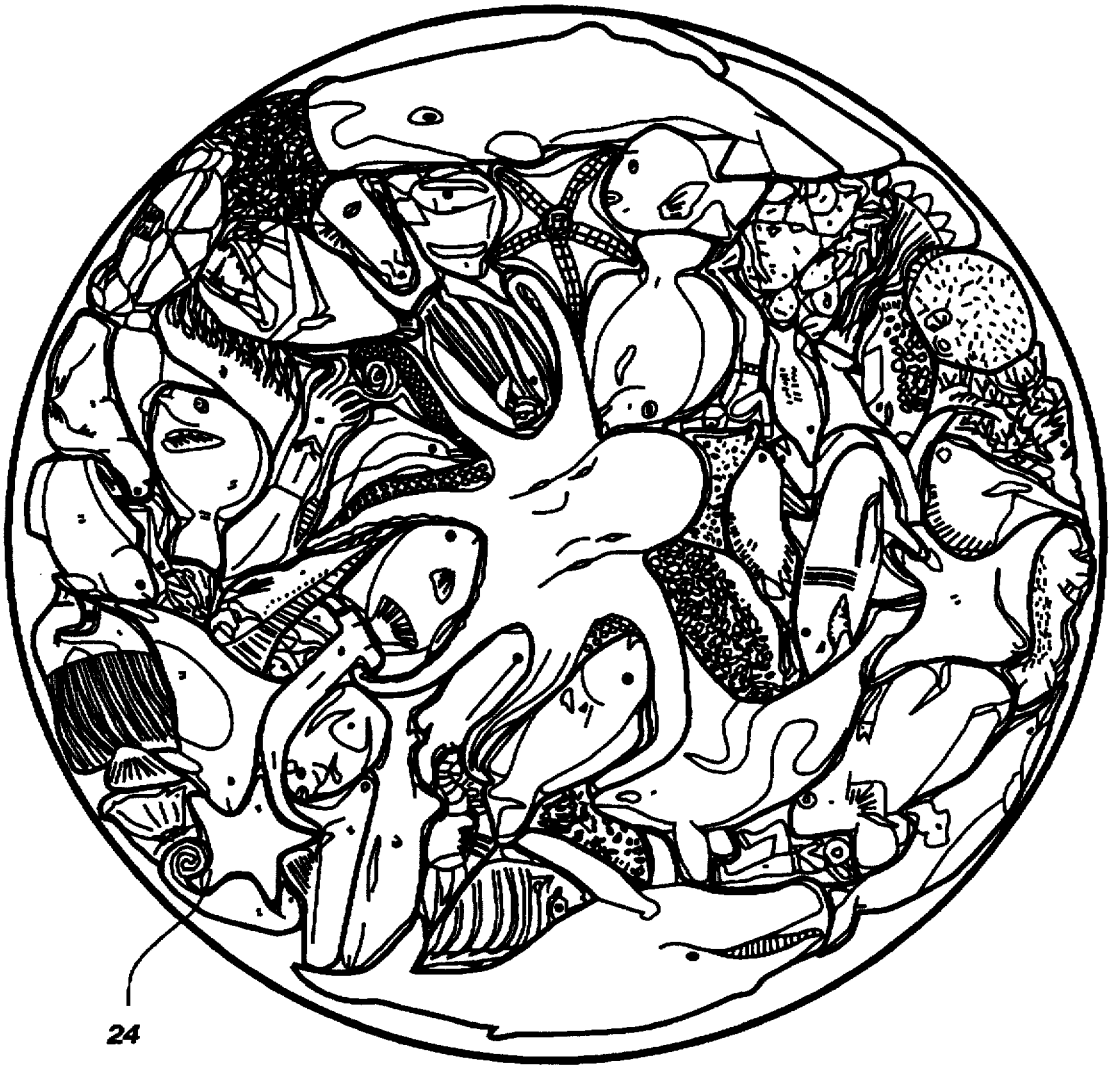
FIG. 4 is a perspective view of another preferred embodiment of the assembled puzzle toy set.

FIG. 4 is a perspective view of another preferred embodiment of the assembled puzzle toy set 10 employing an aquatic sea life theme. A starfish puzzle piece 24 has one side showing its external features.

Figure 5:
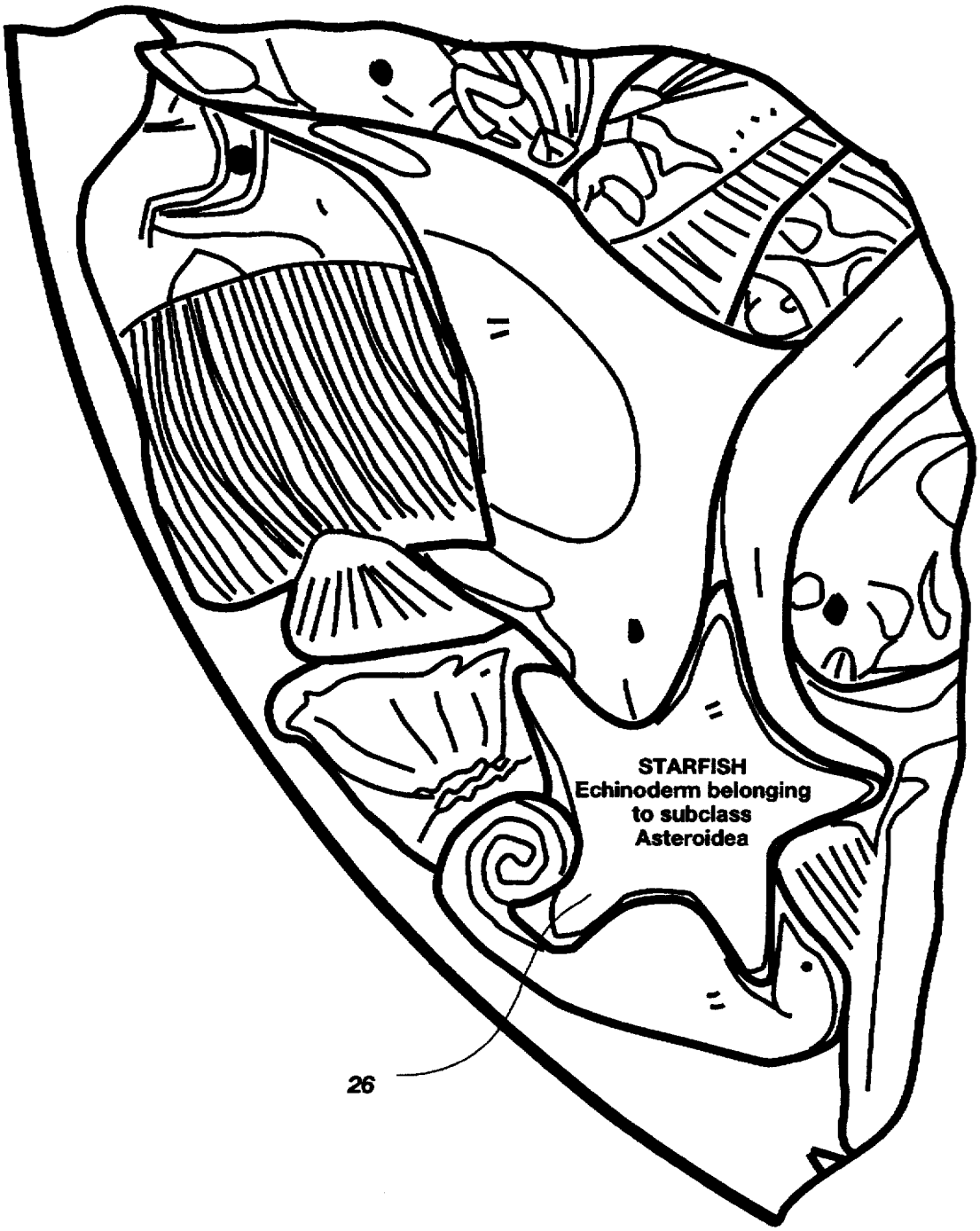
FIG. 5 is a perspective view of one side of the puzzle pieces shown in FIG. 4.

FIG. 5 is a perspective view of the reverse side 26 of the starfish puzzle piece 24 shown in FIG. 4 showing the scientific name and classification of the starfish on its reverse side.

Although this specification has made specific reference to the illustrated embodiments, it is not intended to restrict the scope of the appended claims. The claims themselves recite those features deemed essential to the invention.

I claim:

1. An educational puzzle toy set comprising:

a plurality of interlocking and non-interlocking puzzle pieces having a common theme, each individually shaped as a silhouette or outline of an animal, plant, or toy with arms, legs, appendages, and body parts, which interconnect when assembled to form a patterned assemblage, and an interlocking puzzle border comprised of a plurality of interlocking border pieces, which when assembled, define a template of a corresponding shape to the patterned assemblage to secure and hold together the assembled puzzle pieces; said puzzle border colored and patterned proximate each puzzle piece with a pictorial setting of an eco-system or environment where the represented animal or plant on the puzzle piece is found; said interlocking border and puzzle pieces structured such that they cannot be interfitted together to form a three dimensional part.

2. An educational puzzle toy set according to claim 1, wherein one side of each puzzle piece contains the name of the animal or plant, its place of origin, size, and other relevant information.

3. An educational puzzle toy set according to claim 1, wherein one side of the puzzle pieces are colored and patterned to accurately depict the exterior of a plant, animal, or toy, and the other side of the puzzle pieces are colored and patterned to show the interior structure of the plant, animal, or toy.

4. An educational puzzle toy set according to claim 1, wherein at least one side of the puzzle pieces is constructed of a dual image holographic material Which when tilted at one angle shows the exterior of a plant, animal, or toy, and when tilted at another angle shows the interior or skeletal structure of the plant, animal, or toy.

5. An educational puzzle toy set according to claim 1, wherein at least one side of the puzzle pieces is constructed of a superimposed dual image material covered by a transparent grid, which, when tilted at one angle shows a first view of a plant, animal, or toy, and when tilted at another angle shows a second view of the plant, animal, or toy.

6. An educational puzzle toy set according to claim 1, wherein some of the puzzle pieces are each shaped as dinosaurs, and some of the puzzle pieces are shaped as paleontologists searching for dinosaurs.

7. An educational puzzle toy set according to claim 6, wherein the dinosaurs are all from the same geological period.

8. An educational puzzle toy set according to claim 7, wherein the puzzle boarder is colored and patterned proximate each puzzle piece with a picture of the eco-system or faunal region from the same geological periods as the dinosaurs into which the assembled puzzle pieces are assembled and fit.

9. An educational puzzle toy set according to claim 1, wherein the puzzle pieces are constructed of a compressible material.

10. An educational puzzle toy set according to claim 9 wherein the puzzle pieces are each sized to prevent ingestion by an infant.

11. An educational puzzle toy set comprising:

a plurality of interlocking puzzle pieces having a common theme, each individually shaped as the silhouette or outline of an animal, plant, or toy with arms, legs, appendages, and body parts, which interconnect when assembled to form a patterned assemblage; each puzzle piece having a first and second side, i. a first side colored and patterned to show the exterior of the animal, plant, or toy, and ii. the second side containing the name of the animal or plant, its place of origin, size, and other relevant information; and an interlocking puzzle border comprised of border pieces, which when assembled, define a template of a corresponding shape to the patterned assemblage to secure and hold together the assembled puzzle pieces; said puzzle border colored and patterned proximate each puzzle piece with a pictorial setting of the eco-system or environment where the animal or plant puzzle piece is found.

12. An educational puzzle toy set according to claim 11, wherein at least one side of the puzzle pieces is constructed of a dual image holographic material which when tilted at one angle shows the exterior of a plant, animal, or toy, and when tilted at another angle shows the interior or skeletal structure of the plant, animal, or toy.

13. An educational puzzle toy set according to claim 12, wherein at least one side of the puzzle pieces is constructed of a superimposed dual image material covered by a transparent grid, which, when tilted at one angle shows a first view of a plant, animal, or toy, and when tilted at another angle shows a second view of the plant, animal, or toy.

14. An educational puzzle toy set according to claim 10, wherein some of the puzzle pieces are each shaped as dinosaurs, and some of the puzzle pieces are shaped as paleontologists searching for dinosaurs.

15. An educational puzzle toy set according to claim 14, wherein the dinosaurs are all from the same geological period.

16. An educational puzzle toy set according to claim 15, wherein the puzzle boarder is colored and patterned proximate each puzzle piece with a picture of the eco-system or faunal region from the same geological periods as the dinosaurs into which the assembled puzzle pieces are assembled and fit.

17. An educational puzzle toy set according to claim 10, wherein the puzzle pieces are constructed of a compressible material.

18. An educational puzzle toy set according to claim 10, wherein the puzzle pieces are each sized to prevent ingestion by an infant.

* * * * *